US008397530B2

(12) United States Patent
Kitazawa et al.

(10) Patent No.: US 8,397,530 B2
(45) Date of Patent: Mar. 19, 2013

(54) HEAT EXCHANGER, AIR CONDITIONING APPARATUS, AND METHOD FOR MANUFACTURING HEAT EXCHANGER

(75) Inventors: Masaaki Kitazawa, Kusatsu (JP); Takashi Doi, Kusatsu (JP); Tetsuya Yamashita, Kusatsu (JP); Shinji Nagaoka, Kusatsu (JP); Isao Ohgami, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1082 days.

(21) Appl. No.: 12/373,722

(22) PCT Filed: Jun. 29, 2007

(86) PCT No.: PCT/JP2007/063078

§ 371 (c)(1),
(2), (4) Date: Jan. 13, 2009

(87) PCT Pub. No.: WO2008/010398

PCT Pub. Date: Jan. 24, 2008

(65) Prior Publication Data

US 2009/0321059 A1 Dec. 31, 2009

(30) Foreign Application Priority Data

Jul. 18, 2006 (JP) ..... 2006-195115

(51) Int. Cl.
*F28F 1/32* (2006.01)

(52) U.S. Cl. ..... 62/285; 165/151; 29/890.047

(58) Field of Classification Search ..... 165/151, 165/182; 62/285, 288
See application file for complete search history.

(56) References Cited

U.S. PATENT DOCUMENTS

| | | | | | |
|---|---|---|---|---|---|
| 3,902,551 | A | * | 9/1975 | Lim et al. | 165/111 |
| 5,174,366 | A | * | 12/1992 | Nagakura et al. | 165/77 |
| 5,417,279 | A | * | 5/1995 | Wada | 165/122 |
| 5,564,495 | A | | 10/1996 | Yoshihashi et al. | |
| 5,573,059 | A | * | 11/1996 | Hamamoto et al. | 165/124 |
| 5,758,719 | A | | 6/1998 | Yoshihashi et al. | |
| 5,937,668 | A | * | 8/1999 | Jun | 62/290 |
| 7,013,961 | B2 | * | 3/2006 | Song et al. | 165/151 |

FOREIGN PATENT DOCUMENTS

| | | | |
|---|---|---|---|
| CN | 1094508 | A | 11/1994 |
| CN | 1107563 | A | 8/1995 |
| CN | 2307231 | Y | 2/1999 |
| GB | 2 250 578 | A | 6/1992 |
| JP | H04-177092 | A | 6/1992 |
| JP | H06-257977 | A | 9/1994 |
| JP | 8-75238 | A | 3/1996 |
| JP | H11-132684 | A | 5/1999 |
| JP | 2001-004162 | A | 1/2001 |

* cited by examiner

*Primary Examiner* — Allen Flanigan
(74) *Attorney, Agent, or Firm* — Global IP Counselors

(57) ABSTRACT

The present invention provides a heat exchanger, an air conditioning apparatus, and a method for manufacturing the heat exchanger capable of reducing the scattering of condensate water from curved portions to the downstream side in the direction of airflow. An indoor heat exchanger includes lower fins and upper fins. The upper fins are inclined in the direction of the airflow at an angle formed between the longitudinal axis of the upper fins and the vertical direction, the range of the angle being equal to or greater than the range of an angle formed between the longitudinal axis of the lower fins and the vertical direction, and the upper fins are disposed adjacent to top ends of the lower fins. The upper fins have curved portions that are curved in proximity to the portions bordering the top ends of the lower fins on the downstream side in the airflow direction F.

21 Claims, 15 Drawing Sheets

HEAT EXCHANGER, AIR CONDITIONING APPARATUS, AND METHOD FOR MANUFACTURING HEAT EXCHANGER

CROSS-REFERENCE TO RELATED APPLICATIONS

This U.S. National stage application claims priority under 35 U.S.C. §119(a) to Japanese Patent Application No. 2006-195115, filed in Japan on Jul. 18, 2006, the entire contents of which are hereby incorporated herein by reference.

TECHNICAL FIELD

The present invention relates to a heat exchanger, an air conditioning apparatus, and a method for manufacturing a heat exchanger.

BACKGROUND ART

In the past, with air conditioning apparatuses in which heat exchangers are housed, a layout has been proposed in which the heat exchangers are bent multiple times and housed in the apparatus in order to reduce the size of the apparatus.

In the air conditioning apparatus disclosed in Japanese Laid-open Patent Application No. 2001-4162, for example, it is proposed that a cross flow-fan be enclosed, and that the heat exchangers be bent multiple times and then laid out. This air conditioning apparatus is provided with a larger number of portions in which the direction of airflow and the direction of refrigerant flow are opposite of each other, the heat exchange efficiency is reduced to a lesser degree. This is achieved by adopting a special arrangement for the fan and the heat transfer tubes through which the refrigerant flows. In this air conditioning apparatus, downstream scattering of condensate water is reduced because wetting with water is maintained on the downstream side of airflow in the heat exchangers.

SUMMARY OF THE INVENTION

Problems the Invention is Intended to Solve

However, in the air conditioning apparatus disclosed in Japanese Laid-open Patent Application No. 2001-4162 described above, the possibility of condensate water scattering in the multi-bent portions of the heat exchangers has not been considered at all. Specifically, the positions or state of the bent portions of the heat exchangers are merely determined arbitrarily by housing the heat exchangers in a compact manner in the air conditioning apparatus while folding the heat exchangers.

Therefore, depending on the manner of housing, the bent portions of the heat exchangers are sometimes such that the bottom end on the downstream side in the direction of airflow in the upper heat exchanger is positioned farther downstream than in the lower heat exchanger, and there is a danger that condensate water will scatter downstream from this bottom end.

The present invention was designed in view of the matters described above, and an object of the present invention is to provide a heat exchanger, an air conditioning apparatus, and a method for manufacturing a heat exchanger in which it is possible to reduce the scattering of condensate water to the downstream side in the direction of airflow from the bent portions.

Means for Solving these Problems

The heat exchanger according to a first aspect is a heat exchanger for exchanging heat with air flowing through the heat exchanger, the heat exchanger having lower fins and upper fins. The upper fins are inclined in die direction of the airflow at an angle between the longitudinal axis of the upper fins and the vertical axis, and the upper fins are disposed adjacent to the top ends of the lower fins. The upper fins have curved portions that are curved on portions bordering the top ends of the lower fins on the downstream side in the airflow direction.

The upper fins, which are provided so as to be inclined downstream in the airflow direction in relation to the lower fins, have curved portions in proximity to portions bordering the lower fins. Therefore, in cases such as when the heat exchanger functions as a refrigerant evaporator, condensate water that flows downward from the upper fins to the lower fins and downstream in the airflow direction can be made to flow smoothly from the upper fins to the lower fins via the curved portions.

A configuration is thereby made in which downstream-protruding portions such as those in the prior art are not provided, and condensate water can be made to flow downstream and downward by the curved portions, thereby making it possible to reduce the scattering of condensate water to the downstream side in the airflow direction from the curved portions.

The heat exchanger according to a second aspect is the heat exchanger according to the first aspect, wherein the upper fins have upper first edges extending along the longitudinal axis of the upper fins and constituting the downstream side in the airflow direction, and upper second edges constituting the bottom side of the upper fins. The curved portions of the upper fins are provided in proximity to the upper first edges and the upper second edges.

With this arrangement, a structure is provided in which gently sloping shapes are used adjacent to corners on the downstream side underneath the upper fins.

The scattering of condensate water is thereby reduced and condensate water can be made to flow more smoothly downward to the lower fins, even in cases in which the upper fins and lower fins are not in contact via the curved portions.

The heat exchanger according to a third aspect is the heat exchanger according to the first or second aspect, wherein a downstream angle between the longitudinal axis of the upper fins and the longitudinal axis of the lower fins are 110 degrees or greater and 175 degrees or less.

With this arrangement, a positional relationship is provided between the upper fins and lower fins, such that the intersection angles are in a range in which condensate water can be transferred smoothly between the upper fins and lower fins.

Condensate water can thereby be made to flow downward even more reliably.

The heat exchanger according to a fourth aspect is the heat exchanger according to any of the first through third aspects, wherein the curved portions of the upper fins have portions in which R is 3 mm or greater and 6 mm or less.

Taking the size of single condensate water into account, portions are provided in which the extent of curvature of the curved portions is such that R is 3.0 cm or greater and 6.0 cm or less. Therefore, it is possible to prevent condensate water from escaping and to transfer condensate water from the upper fins to the lower fins via the intersecting portions.

The heat exchanger according to a fifth aspect is the heat exchanger according to any of the second through fourth aspects, wherein in a case in which a downstream end of a top end of the lower fins in the airflow direction is used as a reference point, the closest possible distance between the upper first edges and a line extending along the longitudinal axis of the upper fins from the reference point is 1 mm or less. The distance between the upper fins and the reference point of the lower fins may be less than a gap equal to the size of a water droplet (less than 2 mm), and providing the intersecting portions is not always necessary.

In cases in which condensate water flows downward along the downstream side of the upper fins and does not transfer smoothly to the lower fins, the condensate water tends to scatter from the bottom ends on the downstream side of the upper fins.

To overcome this problem, in the heat exchanger of the fifth aspect, the closest possible distance between the upper first edges of the upper fins and a line extending along the longitudinal axis of the upper fins from the reference point of the lower fins is set to 1 mm or less.

Since the downstream ends of the upper fins protrude by a small extend farther downstream from the top ends on the downstream side of the lower fins, the scattering of condensate water can be reduced.

The heat exchanger according to a sixth aspect is the heat exchanger according to any of the first through fourth aspects, wherein the upper fins have a plurality of water conduits extending along the surfaces of the upper fins along the longitudinal axis. The water conduits are not positioned in the curved portions of the upper fins.

In this arrangement, the water conduits can cause condensate water to flow downward along the surface of the fins. In this case, since the water conduits are not provided to the curved portions, it is possible to avoid forming angles in the curved portions.

It is thereby possible to cause condensate water to flow downward along the surface of the fins, and to reduce the scattering of condensate water from the curved portions.

The heat exchanger according to a seventh aspect is the heat exchanger according to any of the first through sixth aspects, wherein the water conduits are provided at least to the top ends in proximity to the downstream side of the lower fins in the airflow direction.

When condensate water flows downward along the curved portions of the upper fins to the lower fins, the water conduits provided at the top ends corresponding to the lower fins efficiently collect the condensate water. The condensate water is thereby smoothly transferred from the upper fins to the lower fins, and it is possible to effectively suppress the scattering of condensate water from the curved portions.

The heat exchanger according to an eighth aspect is the heat exchanger according to any of the first through sixth aspects, wherein the upper fins have a plurality of openings passing through the fins in the thickness direction, the openings being aligned at a predetermined pitch along the longitudinal axis. The heat exchanger further comprises a plurality of heat transfer tubes fitted through each of the plurality of openings. Of the plurality of openings, the openings closest to the curved portions are disposed so that the closest possible distance from the curved portions is half of the predetermined pitch or less.

Condensate water readily collects in the portions where the heat transfer tubes are fitted through the fins, but in the heat exchanger of the eighth aspect, the curved portions are provided to nearby positions equal to or less than half of the predetermined pitch between the ducts through which the heat transfer tubes of the fins are fitted.

Therefore, condensate water flowing downward from the portions where the heat transfer tubes are fitted through the fins flows readily along the nearby curved portions, and the scattering of condensate water can be effectively reduced.

The heat exchanger according to a ninth aspect is the heat exchanger according to any of the first through sixth aspects, wherein the top ends of the lower fins on the downstream side in the airflow direction have recessed concavities.

With this arrangement, a structure is provided in which when condensate water flows downward along the curved portions of the upper fins to the lower fins, the concavities provided at the corresponding top ends of the lower fins prevent the condensate water from escaping, and the condensate water is readily collected. Condensate water can thereby be more reliably transferred from the upper fins to the lower fins, and it is possible to effectively suppress the scattering of condensate water from the curved portions.

The heat exchanger according to a tenth aspect is the heal exchanger according to any of the first through sixth aspect, wherein a bending angle between the longitudinal axis of the lower fins and the longitudinal axis of the upper fins is 5 degrees or greater and 70 degrees or less in cases in which the velocity of the airflow is 0.5 m/s or greater and 4.5 in/s or less.

The scattering of condensate water can herein be effectively reduced at an air rate used when air conditioning is performed.

The heat exchanger according to an eleventh aspect comprises the heat exchanger according to any of the first through tenth aspects, and an air-blowing device for forming an airflow.

Even in the case of a heat exchanger provided with bent portions and capable of being housed in a compact manner, the air-blowing device forms an airflow that can efficiently perform heat exchange in several portions of the heat exchanger.

It is thereby ensured that heat exchange efficiency will not be reduced, the space needed to install the heat exchanger can be made smaller, and condensate water can be made to flow downward to the downstream side.

The method for manufacturing a heat exchanger according to a twelfth aspect is a method for manufacturing a heat exchanger for exchanging heat with air flowing through the heat exchanger, the method comprising a dividing step, a curve formation step, and an inclining step. In the dividing step, the fins are divided into upper fins and lower fins. In the curve formation step, curved portions are formed that are curved in proximity to the downstream side of the airflow direction and in proximity to portions bordering the lower fins in the upper fins. In the inclining step, the fins are brought into a relationship in which the longitudinal axes are inclined relative to each other by turning the fins in relation to each other about a point adjacent to an approximate transverse center of the fins in a bordering portion between the upper fins and the lower fins, and the fins are brought to a position where the downstream ends of the upper fins in the airflow direction and the downstream ends of the lower fins in the airflow direction are joined via the curved portions.

The fins are divided into upper fins and lower fins, and the upper fins are inclined on downstream side in the airflow direction in relation to the lower fins. Curved portions are formed on the upper fins in proximity to the bordering portions joined with the lower fins. Therefore, in cases such as when the resulting heat exchanger functions as a refrigerant evaporator, even if condensate water flows downward from the upper fins to the lower fins towards the downstream side in the airflow direction, the condensate water can be made to flow smoothly from the upper fins to the lower fins via the curved portions.

It is thereby possible to manufacture a heat exchanger in which scattering of condensate water from the local protruding structural portions on the downstream side is reduced, and condensate water is made to flow to the downstream side.

Effects of the Invention

In the heat exchanger of the first aspect, a configuration is adopted in which downstream-protruding portions such as those in the prior art are not provided, and condensate water can be made to flow downstream and downward by the curved portions, thereby making it possible to reduce the scattering of condensate water to the downstream side in the airflow direction from the curved portions.

In the heat exchanger of the second aspect, the scattering of condensate water can be reduced and the condensate water can be made to flow more smoothly downward to the lower fins.

In the heat exchanger of the third aspect, condensate water can be made to flow downward even more reliably.

In the heat exchanger of the fourth aspect, it is possible to prevent condensate water from escaping and to transfer the condensate water from the upper fins to the lower fins via the intersecting portions.

In the heat exchanger of the fifth aspect, since tire downstream ends of the upper fins protrude by a small extend farther downstream from the top ends on the downstream side of the lower fins, the scattering of condensate water can be reduced.

In the heat exchanger of the sixth aspect, it is possible to cause condensate water to flow downward along the tops of the fins, and to reduce the scattering of condensate water from the curved portions.

In the heat exchanger of the seventh aspect, condensate water is smoothly transferred from the upper fins to the lower fins, and it is possible to effectively suppress the scattering of condensate water from the curved portions.

In the heat exchanger of the eighth aspect, condensate water flowing downward from the portions where the heat transfer tubes are fitted through the fins flows readily along the nearby curved portions, and the scattering of condensate water can be effectively reduced.

In the heat exchanger of the ninth aspect, condensate water can be more reliably transferred from the upper fins to the lower fins, and it is possible to effectively suppress the scattering of condensate water from the curved portions.

In the heat exchanger of the tenth aspect, the scattering of condensate water can be effectively reduced at an air rate used when air conditioning is performed.

In the heat exchanger of the eleventh aspect, it is ensured that heat exchange efficiency will not be reduced, the space needed to install the heat exchanger can be made smaller, and condensate water can be made to flow downward to the downstream side.

In the method for manufacturing a heat exchanger of the twelfth aspect, it is possible to manufacture a heat exchanger in which scattering of condensate water from the local protruding structural portions on the downstream side is reduced, and condensate water is made to flow to the downstream side, as in the prior art.

DETAILED DESCRIPTION OF THE INVENTION

Embodiments of the air conditioning apparatus according to the present invention are described hereinbelow with reference to the drawings.

<General Configuration of Air Conditioning Apparatus>

An air conditioning apparatus 100 in which an embodiment of the present invention is used comprises an indoor unit 1 installed in a wall surface of a room, and an outdoor unit 2 installed outdoors.

A heat exchanger is housed within both the indoor unit 1 and the outdoor unit 2, and the heat exchangers are connected by refrigerant supply tubes to form a refrigerant circuit.

<Overall Configuration of Refrigerant Circuit of Air Conditioning Apparatus 100>

Figure 1:
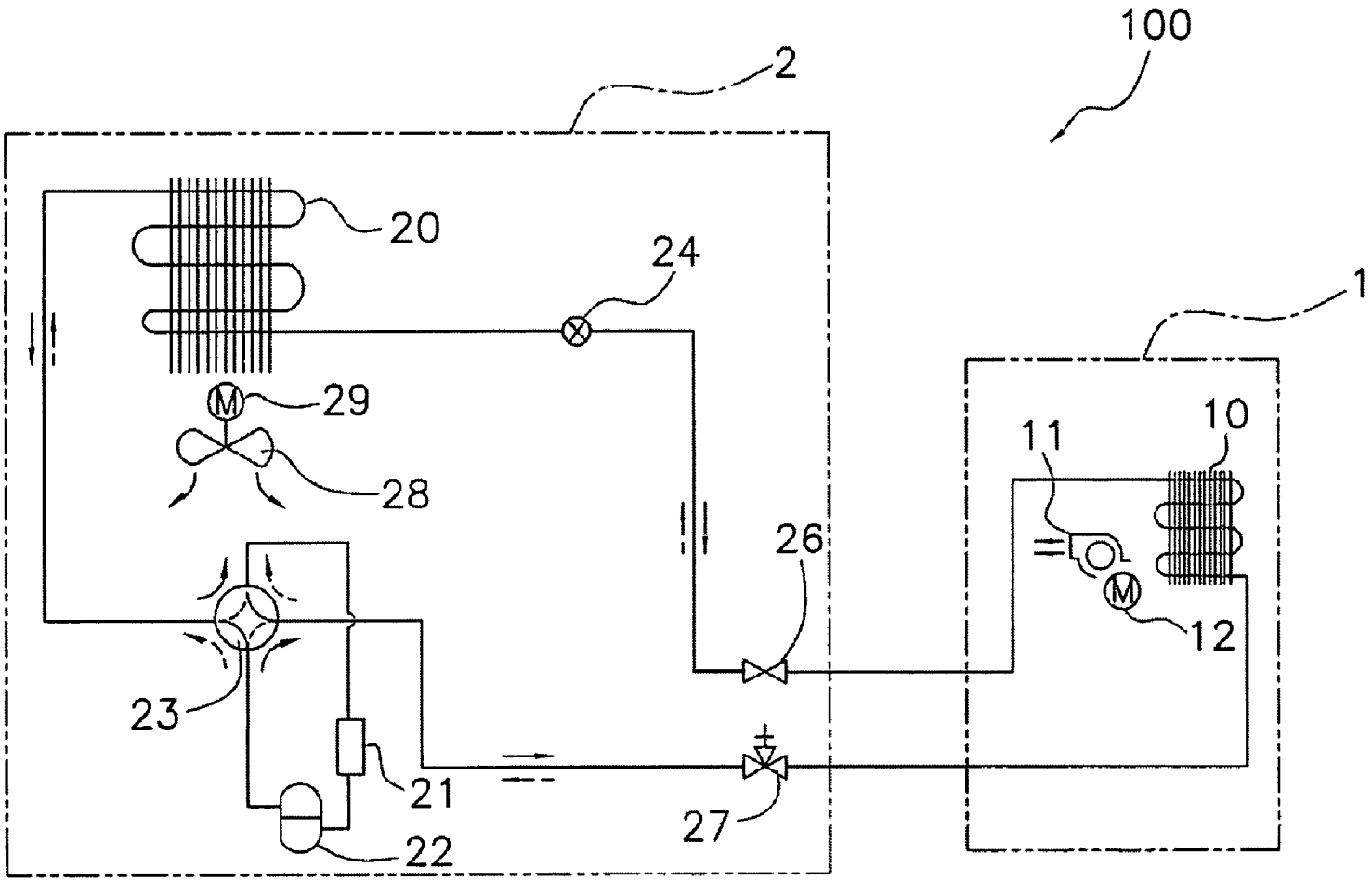
FIG. 1 is the refrigerant circuit of the air conditioning apparatus in which an embodiment of the present invention is used.

The configuration of the refrigerant circuit of the air conditioning apparatus 100 is shown in FIG. 1.

The refrigerant circuit is configured primarily from an indoor heat exchanger 10, an accumulator 21, a compressor 22, a four-way switching valve 23, an outdoor heat exchanger 20, and an expansion valve 24.

Figure 2:
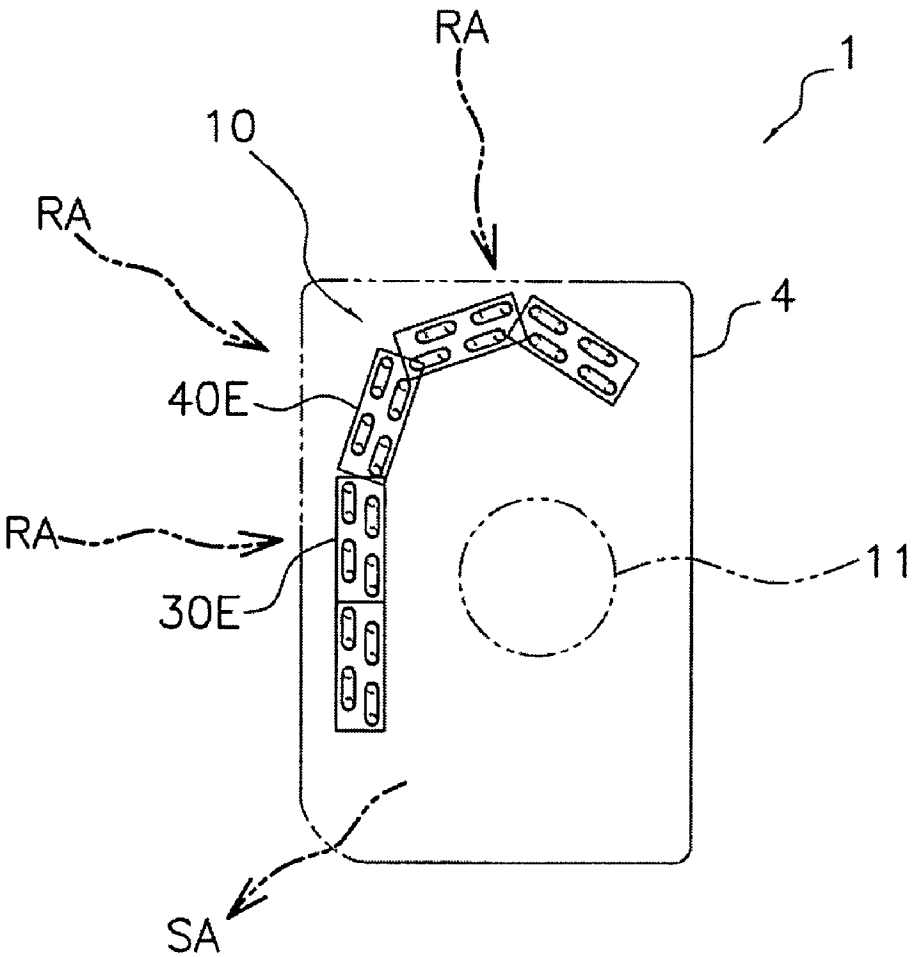
FIG. 2 is a side view of the indoor unit.

The indoor heat exchanger 10 provided to the indoor unit 1 exchanges heat with the air in contact with the heat exchanger. The indoor unit 1 is also provided with a cross-flow fan 11 for expelling air into the room after indoor air has been drawn in, passed through the indoor heat exchanger 10, and subjected to heat exchange. The cross-flow fan 11 is rotatably driven by one indoor fan motor 12 provided in the indoor unit 1. The cross-flow fan 11 is disposed within an indoor unit casing 4 as shown in FIG. 2, which is a side view of the indoor unit 1, wherein intake ports shown by the double-dashed lines are provided to the front and top, and a discharge port is provided to the bottom. The indoor heat exchanger 10 is bent multiple times and then disposed in the indoor unit casing 4 so that the cross-flow fan 11 is disposed in a space bounded by the intake ports and the heat exchanger. For example, in a environment in which the velocity of the airflow F during an air conditioning operation is 0.5 m/s or greater and 4.5 m/s or less, fins are folded multiple times and then disposed such that the folding angle of the longitudinal axis of lower fins 30 in relation to the longitudinal axis of upper fins 40 is 5 to 70 degrees. When the cross-flow fan 11 is rotatably driven, the indoor unit 1 takes in indoor air RA via the indoor heat exchanger 10 and returns conditioned air SA that has undergone heat exchange back into the room, thereby conditioning the air.

The outdoor unit 2 is provided with a compressor 22, a four-way switching valve 23 connected to the discharge side of the compressor 22, an accumulator 21 connected to the intake side of the compressor 22, an outdoor heat exchanger 20 connected to the four-way switching valve 23, and an expansion valve 24 connected to the outdoor heat exchanger 20. The expansion valve 24 is connected to a supply tube via a liquid shut-off valve 26, and is connected to one end of the indoor heat exchanger 10 via the supply tube. The four-way switching valve 23 is connected to a supply tube via a gas shut-off valve 27, and is connected to the other end of the indoor heat exchanger 10 via the supply lube. The outdoor unit 2 is also provided with a propeller fan 28 for expelling air to the exterior after the air has undergone heat exchange in the outdoor heat exchanger 20. The propeller fan 28 is rotatably driven by an outdoor fan motor 29.

The following is a description of the detailed configuration of the indoor heat exchanger 10 of the indoor unit 1.

<Structure of Indoor Heat Exchanger 10>

Figure 3:
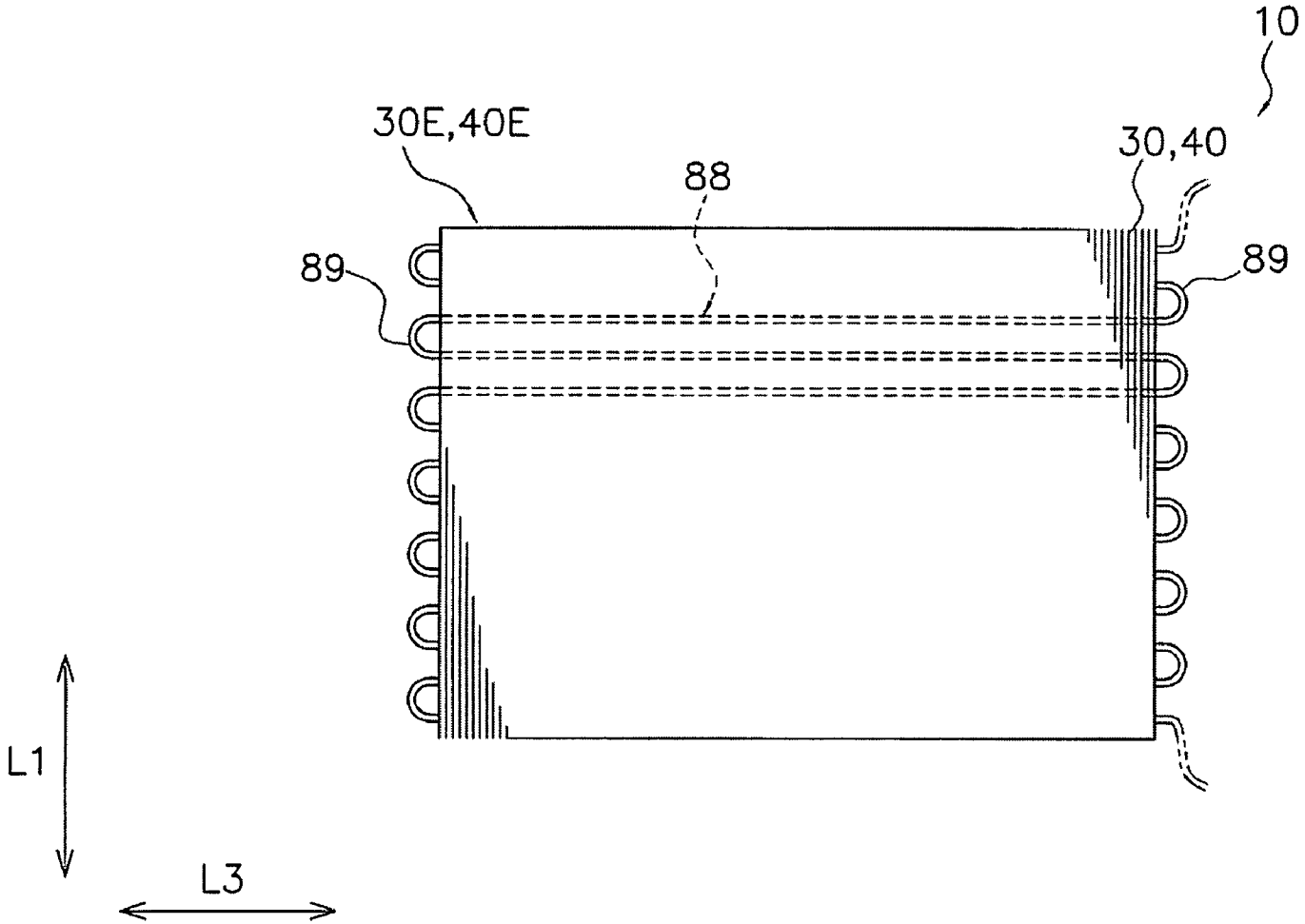
FIG. 3 is a front view of the fins of a heat exchanger.
Figure 4B:
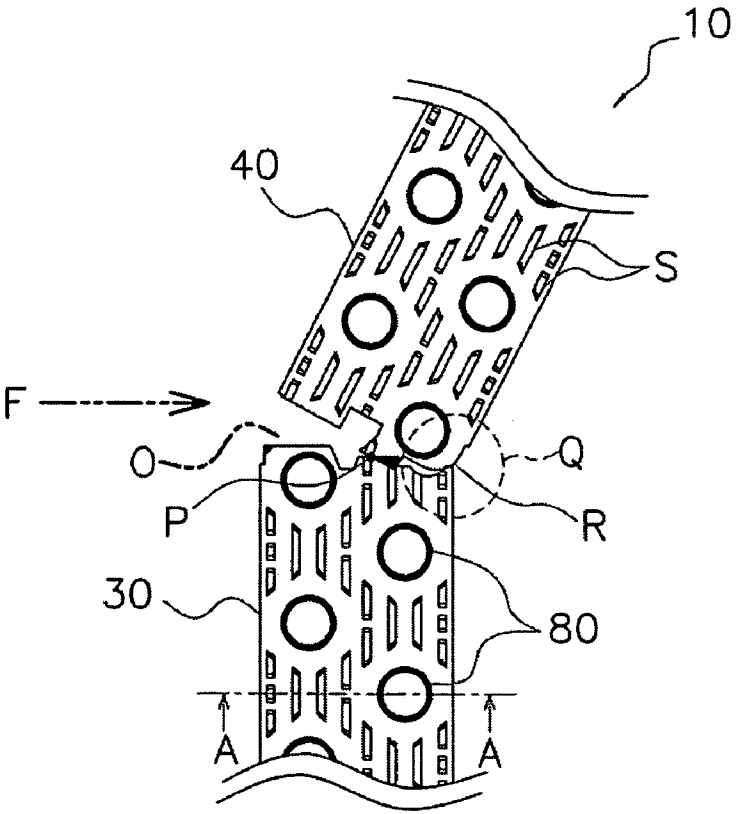
FIG. 4(*a*) is a plan view showing the state of the fins before folded, and FIG. 4(*b*) is a plan view showing the state of the fins after folded.
Figure 4A:
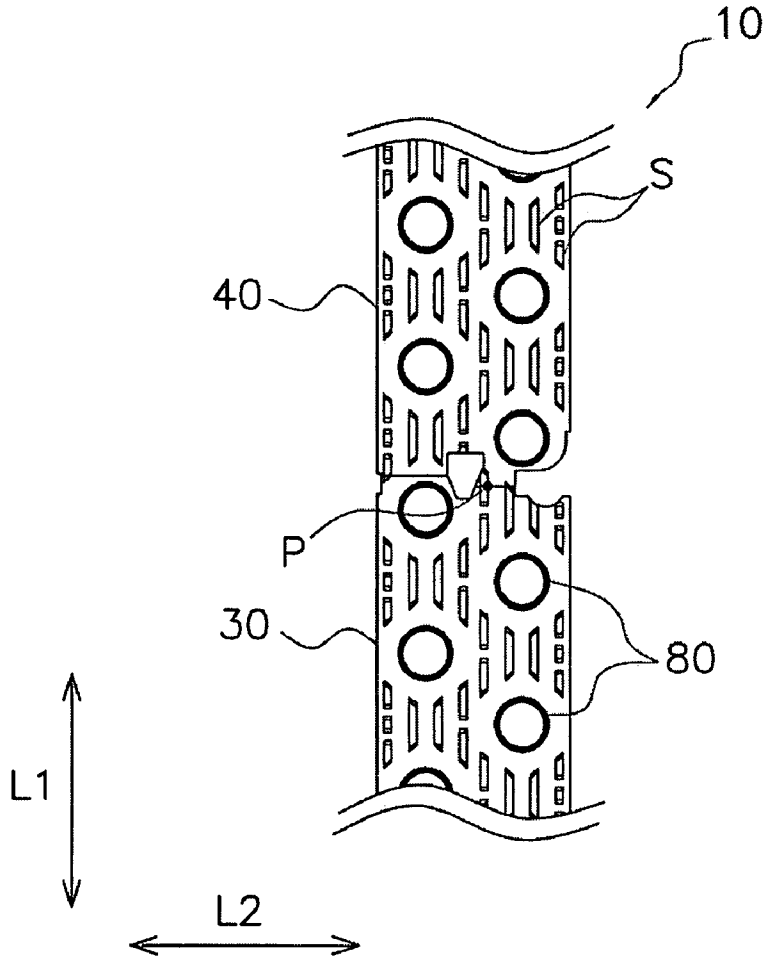

A front view of the indoor heat exchanger 10 of the present invention is shown in FIG. 3. FIGS. 4(*a*) and 4(*b*) show a detailed plan view of the lower fins 30 and upper fins 40 constituting the indoor heat exchanger 10.

In these drawings, L1 denotes the longitudinal direction of the fins, L2 denotes the transverse direction of the fins, and L3 denotes the sheet thickness direction of the fins.

The indoor heat exchanger 10 is a cross-fin type heal exchanger having the outward shape of a rectangular flat sheet, and is also a multi-bent heat exchanger as shown in FIG. 3, configured from a plurality of heat exchange parts 30E, 40E, etc.

The heat exchange parts 30E, 40E of the indoor heat exchanger 10 comprise a plurality of hairpin-shaped heat transfer tubes 88 disposed substantially parallel to each other; a plurality of fins 30, 40 disposed at predetermined intervals in the sheet thickness direction, the fins having holes through which the heat transfer tubes 88 pass in the sheet thickness direction; and hairpin parts 89 of the heat transfer tubes 88. The upper heat exchange parts 40E are disposed above the lower heat exchange parts 30E so that the angles of inclination differ as shown in FIG. 2. The lower heat exchange parts 30E are configured from a plurality of lower fins 30, and the upper heat exchange parts 40E are configured from a plurality of upper fins 40, as shown in FIG. 3.

Of the fins 30, 40, the details of the areas adjacent to the lower fins 30 and upper fins 40 are described hereinbelow.

(Detailed Configuration of Fins)

FIG. 4(*a*) is a plan view showing the state of the lower fins 30 and upper fins 40 before being folded, and FIG. 4(*b*) is a plan view showing the positional relationship between the lower fins 30 and upper fins 40 after being folded.

Figure 5:
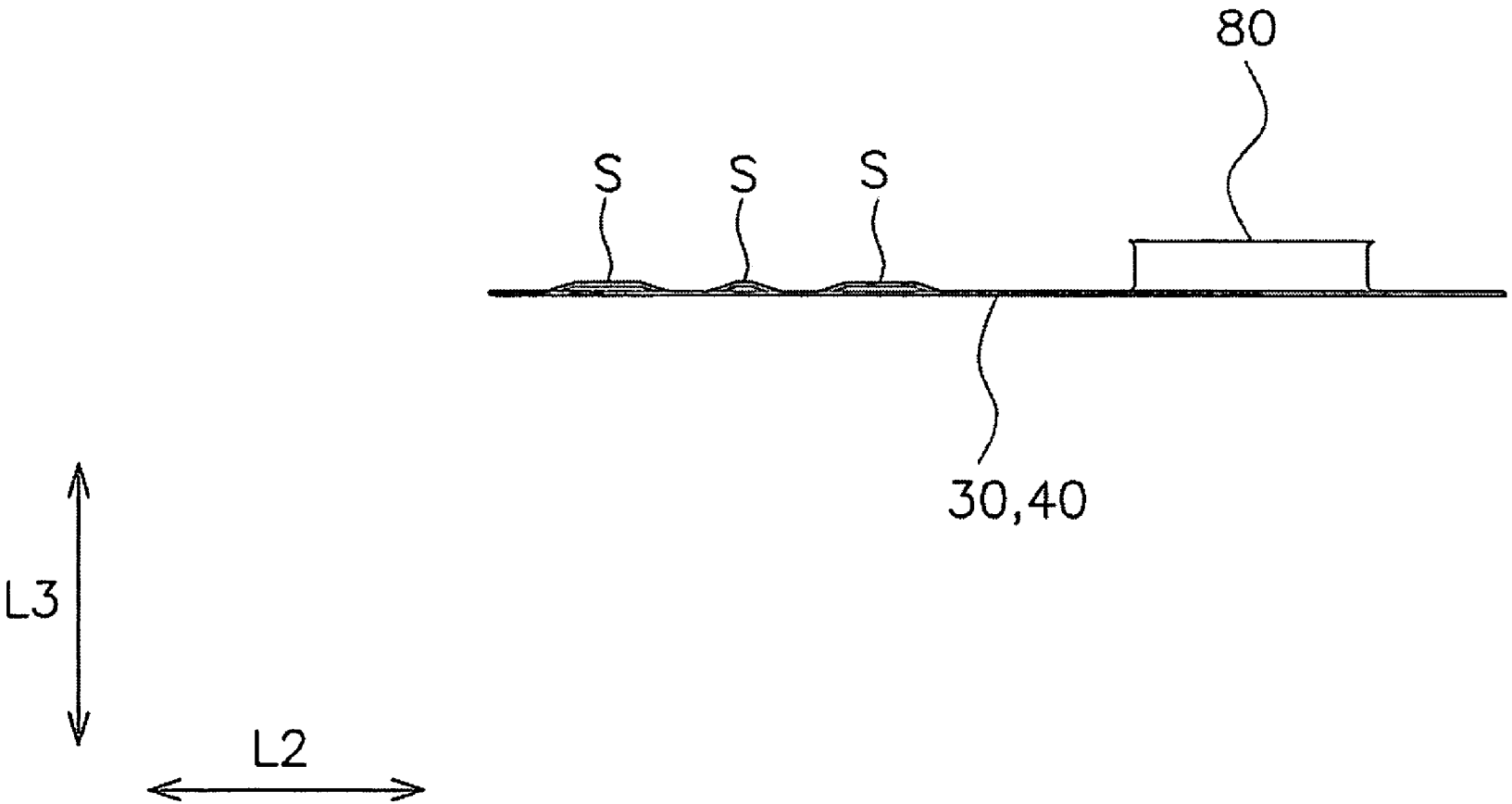
FIG. 5 is a cross-sectional view along line A-A in FIG. 4(*b*).

FIG. 5 is a cross-sectional view along line A-A in FIG. 4(*b*).

Figure 6:
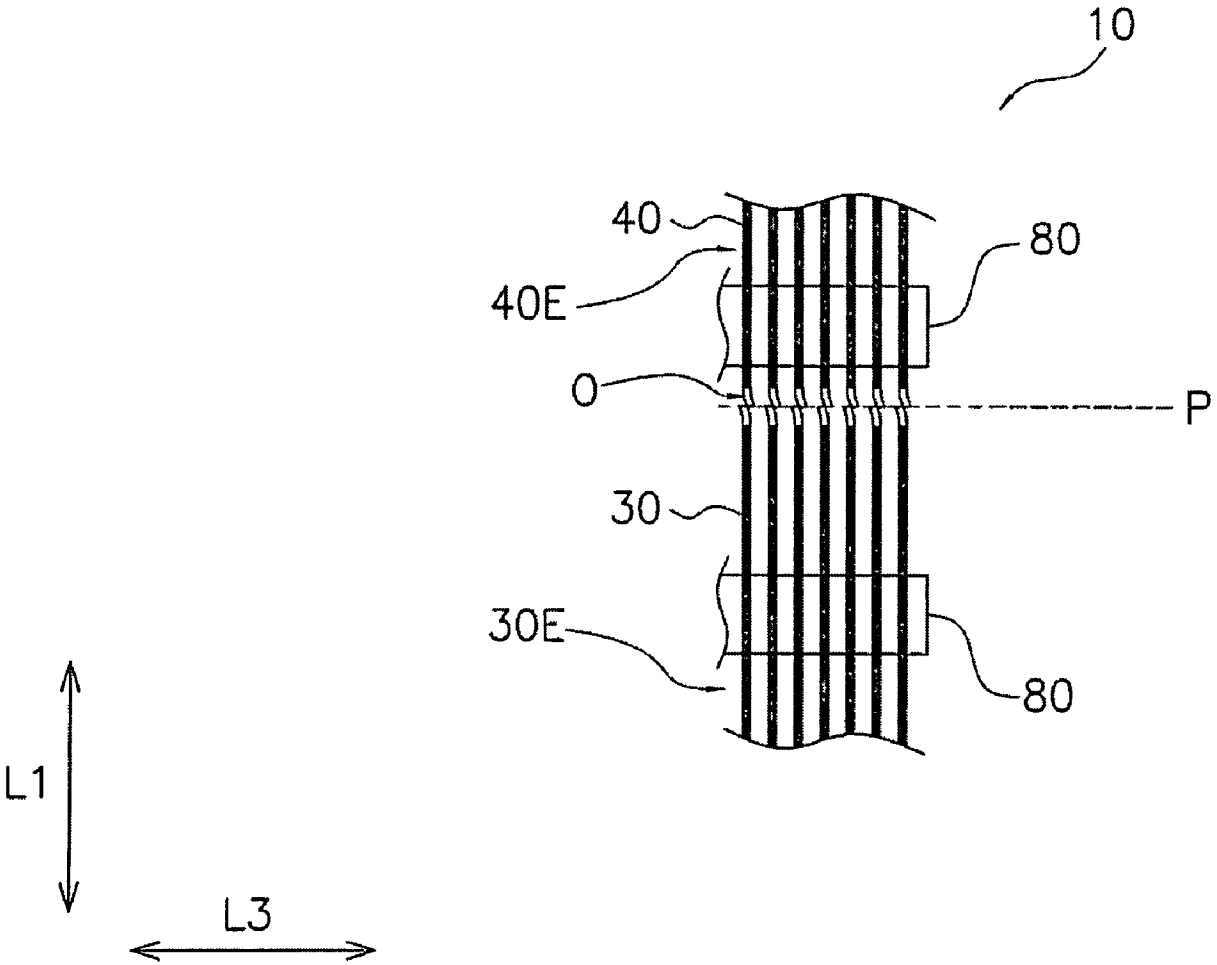
FIG. 6 is a partial enlarged front view of the folded portions.

FIG. 6 is an enlarged partial plan view of an area adjacent to the curved portion R of an upper fin 40.

Figure 7:
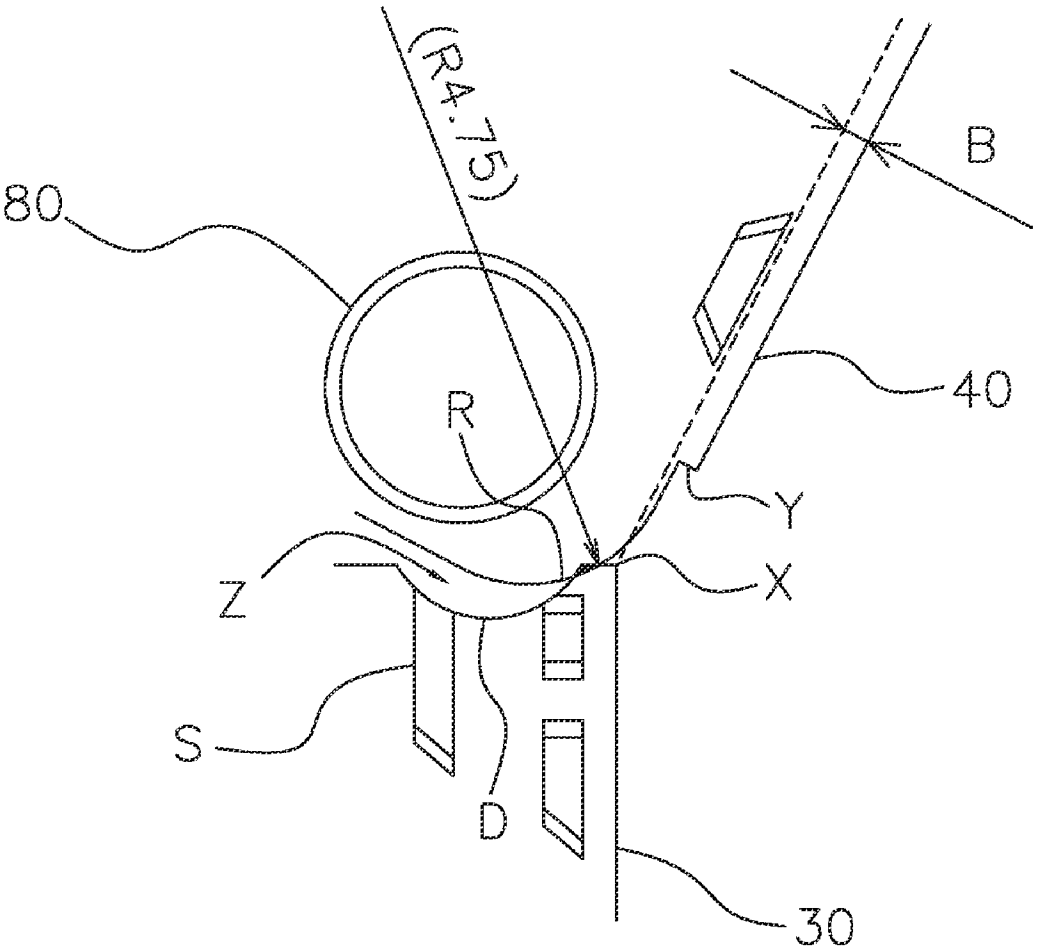
FIG. 7 is a partial enlarged plan view of a curved portion.

FIG. 7 is an enlarged partial front view of an area adjacent to the folded portion of the indoor heat exchanger 10.

The lower fins 30 and upper fins 40 are described hereinbelow with reference to these drawings.

(Fin Configuration)

The lower fins 30 and the upper fins 40 have a length of 24 mm in the transverse direction and a thickness of 0.1 mm, and both comprise holes 80 and distended slits S. The distended slits S form water conduits. The holes 80 are circular holes passing through fins in the sheet thickness direction, and the holes are provided in two rows at a predetermined pitch (intervals of 12 mm) along the longitudinal axis of the fins. The holes 80 in these two rows are arranged so as to be shifted along the longitudinal axis by a half pitch. The distended slits S including a plurality of slits extend along the longitudinal axis. The plurality of distended slits S form a single unit, and the slits are provided so as to repeatedly alternate with the holes 80 along the longitudinal axis at predetermined intervals as long as the pitch of the holes 80. The holes 80 and the distended slits S are formed by the distending of the fins in the sheet thickness direction, as shown in the A-A cross-sectional view of FIG. 5. In this arrangement, the peripheries of the holes 80 are substantially cylindrical. The distended slits S are formed by cutting notches in the longitudinal direction and distending the notches by elastically deforming the notches in the sheet thickness direction of the fins, and the transverse direction of the fins passes through the distended portions. The height of the distended slits S is about 0.6 mm, including the sheet thickness of the fins. The surface tension of the condensate water is thereby facilitated by the presence of the thin slits of about 0.6 mm in cases in which condensate water forms on the fin surfaces when the indoor heat exchanger 10 is functioning as a refrigerant evaporator. Therefore, in the distended slits S, the condensate water is transferred to the slit portions rather than being scattered, whereby is it possible to facilitate a downward flow.

The heat transfer tubes 88 are fitted in the sheet thickness direction through the holes 80 provided to the lower fins 30 and upper fins 40, as shown in FIG. 6. A plurality of the lower fins 30 and upper fins 40 are disposed at predetermined intervals in the sheet thickness direction, and the heat transfer tubes 88 are fitted through each of the fins. A collection of a plurality of the lower fins 30 constitutes the lower heat exchange parts 30E, and a plurality of the upper fins 40 constitutes the upper heat exchange parts 40E.

(Fin Notching, etc.)

Areas adjacent to the border between the lower fins 30 and upper fins 40 are notched and cut out as shown in FIG. 4(*a*). In this arrangement, the areas are notched and cut out bilaterally asymmetrically, and the shapes of the notches differ between the side of the heat exchanger positioned upstream of the airflow F and the side of the heat exchanger positioned downstream of the airflow F when the heat exchanger is disposed in the indoor unit casing 4 (see FIG. 4(*b*)). On the upstream side, notches are merely formed in the transverse ends, and the fins are partially cut out in an area that ends a short front side distance from the approximate transverse center. On the downstream side, substantially crescent-shaped concavities D recessed slightly in the longitudinal direction are formed in proximity to the top ends of the lower fins 30 (see FIG. 7). Parts of the distended slits S described above are positioned in these concavities D. Furthermore, curved portions R are formed in proximity to the bottom ends of the upper fins 40 on the downstream side. The curved portions R are provided to the positions that connect the side edges extending in the longitudinal direction on the downstream side of the upper fins 40 and the bottom edges extending substantially perpendicular to the longitudinal axis. The curved portions R are positioned so that the distance from the closest holes 80 is less than half the pitch in the longitudinal direction of the holes 80 described above, and distended slits S are not positioned in the curved portions R.

(Folding of Fins)

In such a state, the lower fins 30 and upper fins 40 have a positional relationship of being folded so that the longitudinal axes of the fins are inclined in relation to each other about a reference point P in the substantial center where the fins are joined, as shown in FIG. 4(*b*). In the folded state, the concavities D of the lower fins 30 have a positional relationship with the curved portions R of the upper fins 40 such that they partially overlap in the sheet thickness direction, as shown in FIG. 4(*b*) and also in FIG. 7, which is an enlarged partial plan view of one of the curved portions R (an enlarged view of the portion indicated by Q in FIG. 4(*b*)). In the folded state, the curved portions R of the upper fins 40 form intersecting portions so as to have a positional relationship in proximity to the distended slits S of the concavities D of the lower fins 30. The curves of the curved portions R in the intersecting portions are formed so that the curvature R is about R 4.75 mm, and the curves are positioned so that the contact angle between the lower fins 30 and upper fins 40 in the intersecting portions is 110 degrees or more and 175 degrees or less. In this arrangement, the positional relationship between the upper fins 40 and lower fins 30 is such that the fins are folded so that 1 mm or less is the closest possible distance B between the downstream side edges of the upper fins 40 and a line extending along the longitudinal axis of the upper fins 40 from the top ends X on the downstream side of the lower fins 30. As seen in FIG. 7, a notch Y is formed in each of the downstream side edges of the upper fins 40. Due to the notch Y, the closest possible distance B decreases as each downstream side edge approaches each respective lower fin 30. Thus, the edges of the folded portions on the downstream side are configured so that there is a smooth connection from the upper fins 40 to the lower fins 30.

The lower fins 30 (lower heat exchange parts 30E) and the upper fins 40 (upper heat exchange parts 40E) are folded so as to be in a relationship in which the longitudinal orientations of the fins are inclined relative to each other about the reference point P, and a gap O is thereby formed in front of the reference point P, as shown in FIGS. 4(*b*) and 6. As shown in FIGS. 4(*b*) and 7, each curved portion R of the upper fins 40 contacts a respective lower fin 30 at a location downstream of a location at which the curved portion R does not contact the lower fin 30 such that a space Z (see FIG. 7) is formed between the curved portion R and the lower fin 30, the space Z being downstream of the reference point P and upstream of the location at which the curved portion R contacts the lower fin 30.

(Steps for Manufacturing Indoor Heat Exchanger 10)

Figure 8:
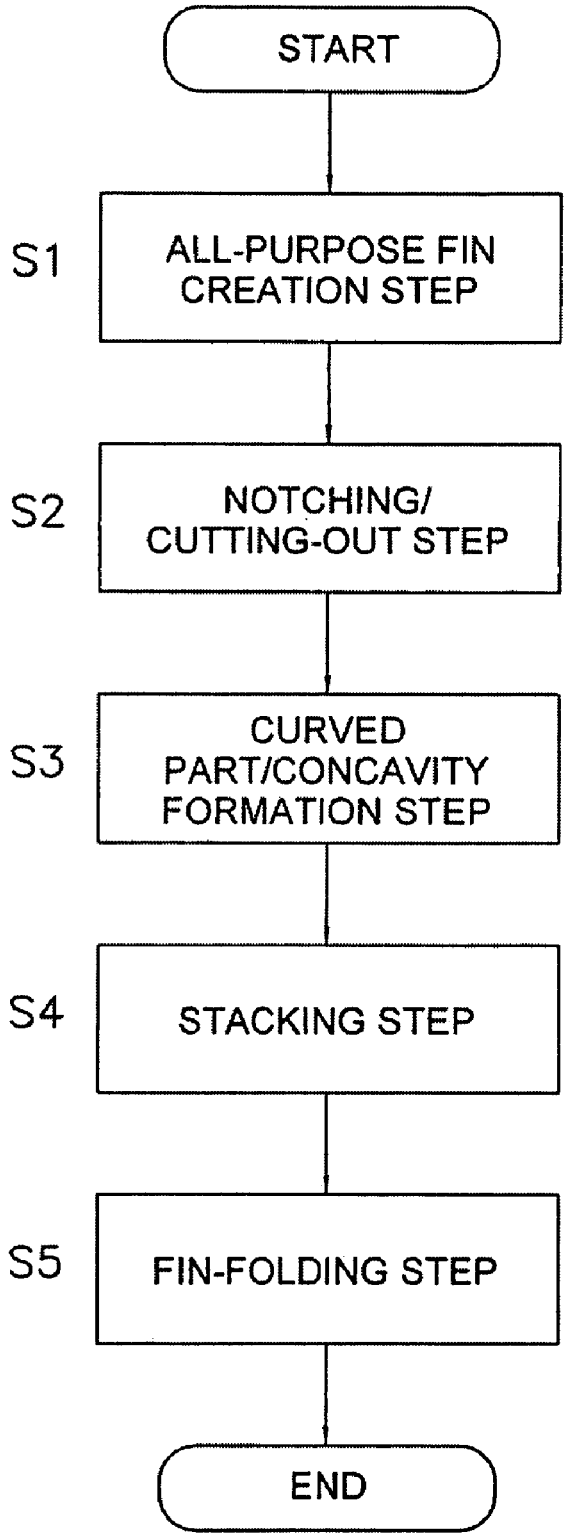
FIG. 8 is a flowchart of the method for manufacturing a heat exchanger.

FIG. 8 shows a flowchart showing the steps for manufacturing the indoor heal exchanger 10.

In step S1, all-purpose fins having a symmetrical form in the transverse direction are prepared.

In step S2, notches are formed on the upstream side in the transverse direction L2 of the Fins 30, 40, and the parts of the Fins in front of the approximate center are cut out.

In step S3, parts are cut away so as to form lower concavities D while forming curved portions R at the top of the downstream side in the transverse direction L2 of the fins 30, 40, and the fins are divided into lower fins 30 and upper fins 40. The lower fins 30 and upper fins 40 have a structure such as is shown in FIG. 4(*a*) at the stage when this step is complete.

In step S4, the lower fins 30 and upper fins 40 are integrated, and a plurality of the integrated fins are stacked on a plurality of aligned heat transfer tubes 88.

In step S5, the integrally stacked lower fins 30, the upper fins 40, and the heat transfer tubes 88 are folded about a reference point P, and folded portions are formed. The lower fins 30 and upper fins 40 have a structure such as is shown in FIG. 4(*b*) at the stage when the folding step is complete.

A multi-bent indoor heat exchanger 10 is manufactured by the steps described above.

<Characteristics of the Indoor Heat Exchanger 10 of the Present Embodiment>

(1)

Figure 15:
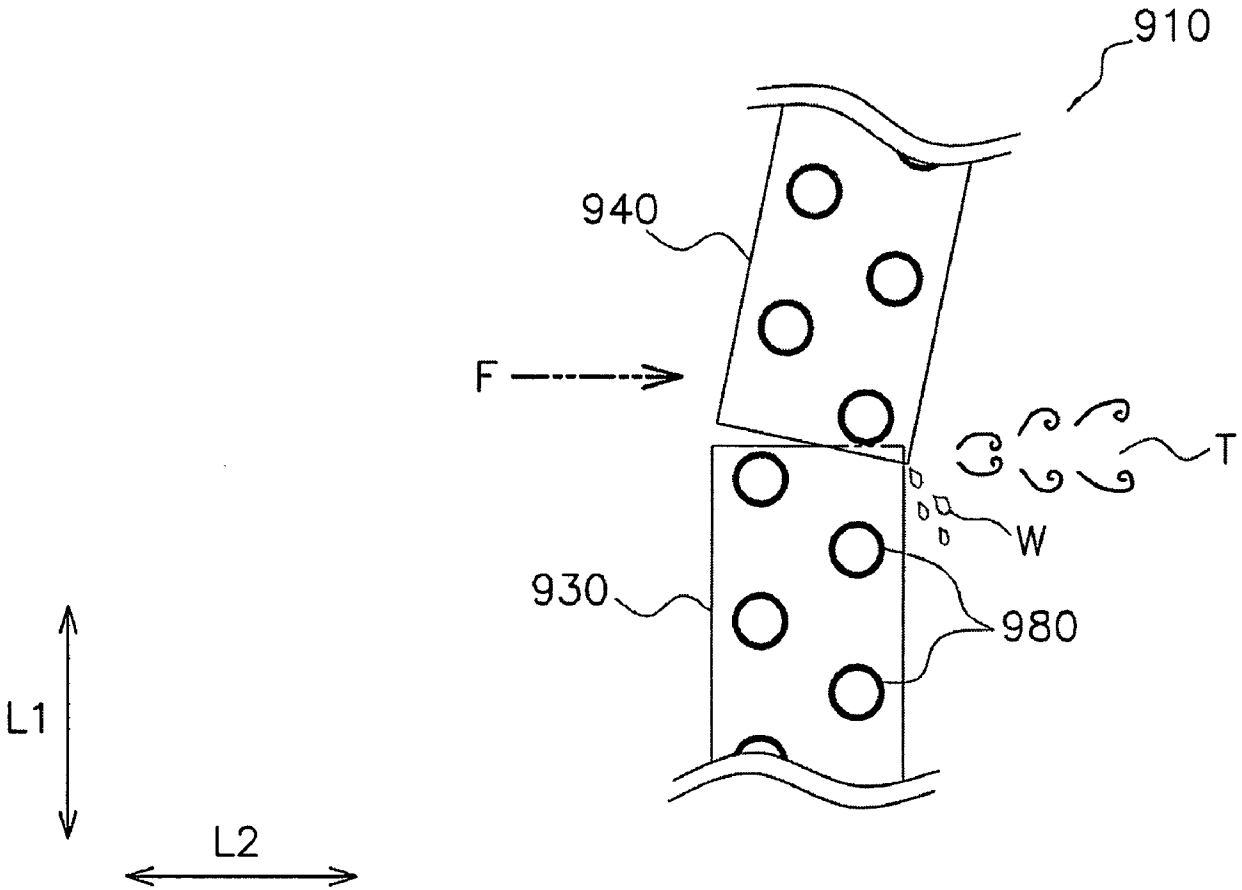
(PRIOR ART) FIG. 15
FIG. 15 is a plan view showing the folded state of fins of a conventional heat exchanger.

In a conventional multi-bent indoor heat exchanger 910, the positions and states of the bent portions are arbitrarily determined by folding the fins so that the fins can be housed within the indoor unit casing in a compact manner as shown in FIG. 15. Therefore, depending on the state of housing, the bottom ends of the upper fins 940 on the downstream side of the airflow direction F in the bent portion of the indoor heat exchanger 910 sometimes protrude even farther downstream than the ends of the lower fins 930 on the downstream side. In such cases, there is a danger that condensate water W will scatter from this point when the indoor heat exchanger 910 functions as a refrigerant evaporator. There is also a danger that turbulence T will occur in the airflow that has undergone heat exchange, and that odd noises will occur.

In the indoor heat exchanger 10 of the present embodiment, curved portions R are formed in the upper fins 40, and the lower fins 30 and upper fins 40 in the folded state are disposed so as to be smoothly joined via the curved portions R; therefore, there are no portions protruding towards the downstream side, as in the prior art. Therefore, in cases such as when the indoor heat exchanger 10 functions as a refrigerant evaporator, even though condensate water may form on the upper fins 40 and flow down while directed towards the downstream side of the airflow direction F, the condensate water can be transferred to the lower fins 30 via the curved portions R. Downward flows toward the lower fins 30 are thereby made even smoother, whereby the scattering of condensate water toward the downstream side can be reduced. Condensate water is also prevented from accumulating in the overlapping portions of the upper fins 40 and lower fins 30 on the downstream side, facilitating downward flow in the lower fins 30, whereby turbulence in the airflow can be reduced and odd noises can be made less prominent.

Moreover, the intersecting portions between the lower fins 30 and upper fins 40 in the folded portions are disposed so that the intersection angles do not become extremely small or extremely large, the curvature R of the intersecting portions is about R 4.75 mm, and the distance B from the top ends X on the downstream side of the lower fins 30 to the side edges on the downstream side of the upper fins 40 is 1 mm or less; therefore, the upper fins 40 and lower fins 30 have a positional relationship such that the fins are smoothly joined together (see FIG. 7). Even in cases in which condensate water flows downward from the downstream side of the upper fins 40 to the lower fins 30, condensate water can thereby be transferred to the lower fins 30 via the intersecting portions while being prevented from escaping, and scattering of the condensate water can be reduced.

(2)

In the indoor heat exchanger 10 of the present embodiment, distended slits S are provided at a predetermined pitch between the holes 80. The distended slits S are arranged in the upper fins 40 so as to not intersect with the curved portions R. Furthermore, since the distended slits S are arranged in the concavities D in the lower fins 30, condensate water from the upper fins 40 can be efficiently collected. Condensate water can thereby be transferred more smoothly from the upper fins 40 to the lower fins 30, and condensate water can be made to flow downward along the fins, thereby suppressing scattering.

(3)

In the indoor heat exchanger 10 of the present embodiment, the curved portions R of the upper fins 40 are provided to positions where the distance from the nearest hole 80 is less than half of the longitudinal pitch of the holes 80. Therefore, condensate water readily collects in the portions where the heat transfer tubes 88 are fitted through the holes 80. The curved portions R are arranged near these fitted portions, whereby condensate water flowing down from the fitted portions readily flows along the nearby curved portions R, and scattering of the condensate water can be effectively reduced.

(4)

The curved portions R of the upper fins 40 are also provided over a comparatively large area of the bottom ends on the downstream side. Therefore, in cases in which the indoor heat exchanger 10 is housed within the indoor unit casing 4 in multiple stages, the angle of inclination between the axes of the upper fins 40 and lower fins 30 sometimes decreases or increases depending on the bending positions, but scattering of the condensate water can be reduced and the condensate water can be made to flow downward in accordance with various folded states.

(5)

In the air conditioning apparatus 100 of the present embodiment, the indoor heat exchanger 10 is housed within the indoor unit casing 4 in a state of being bent multiple times so as to cover the cross-flow fan 11. Therefore, the components of the indoor heat exchanger 10 can effectively exchange heat with the airflow F formed by the cross-flow fan 11. Furthermore, since the indoor heat exchanger 10 is bent multiple times in the casing, the indoor unit 1 can be made more compact, and the installation space can be made smaller.

<Modifications of the Indoor Heat Exchanger 10 of the Present Embodiment>

(A)

For the indoor heat exchanger 10 of the embodiment described above, an example of an indoor heat exchanger 10 was described in which the curved portions R were provided to the upper fins 40 in order to prevent condensate water from scattering.

Figure 9B:
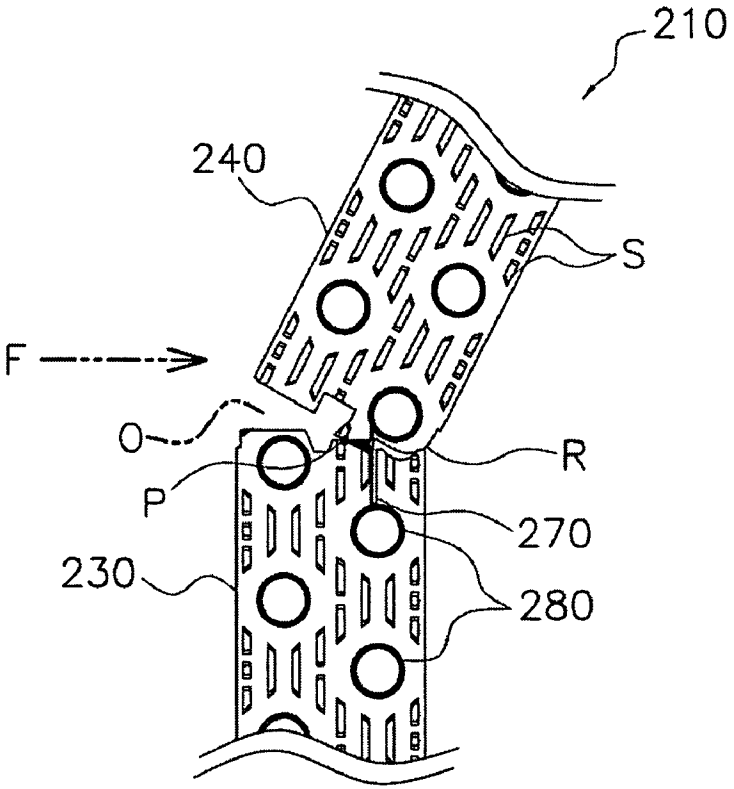
FIG. 9(*a*) is a plan view showing the state of the fins before folded according to Modification (A), and FIG. 9(*b*) is a plan view showing the state of the fins after folded according to Modification (A).
Figure 9A:
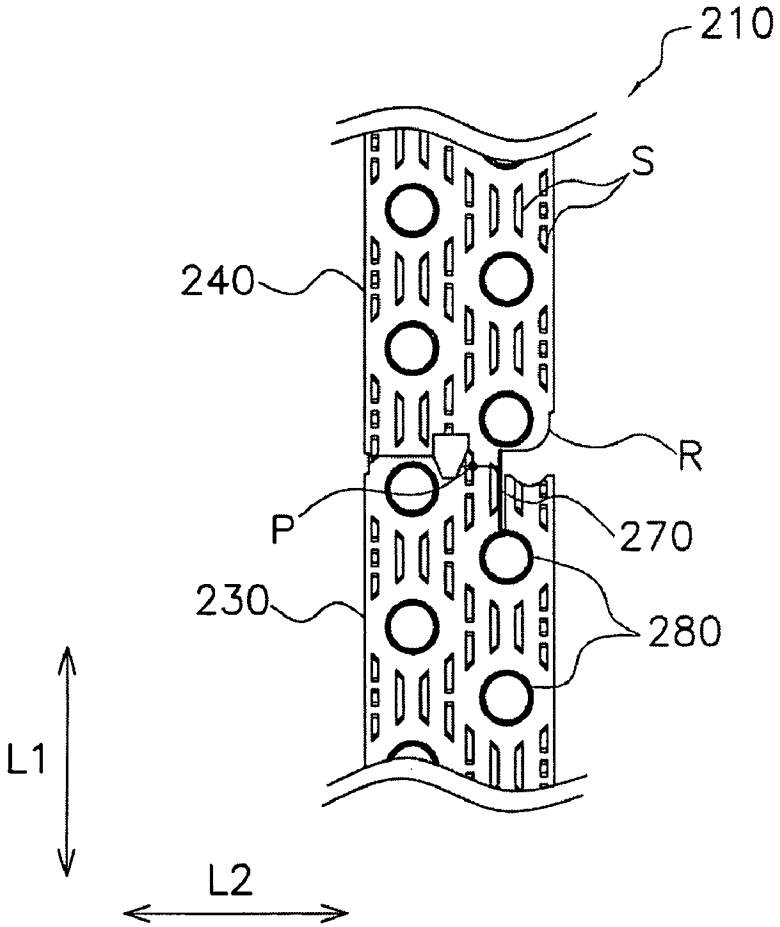

However, the present invention is not limited to this option alone, and another option is a configuration in which not only are curved portions R provided, but air-shielding plates 270 are also provided, as in the indoor heat exchanger 210 shown in FIGS. 9(*a*) and 9(*b*), for example.

The configuration is otherwise identical to that of the embodiment described above, and corresponding components are designated by numerical symbols in the two hundreds and are not described.

Figure 10:
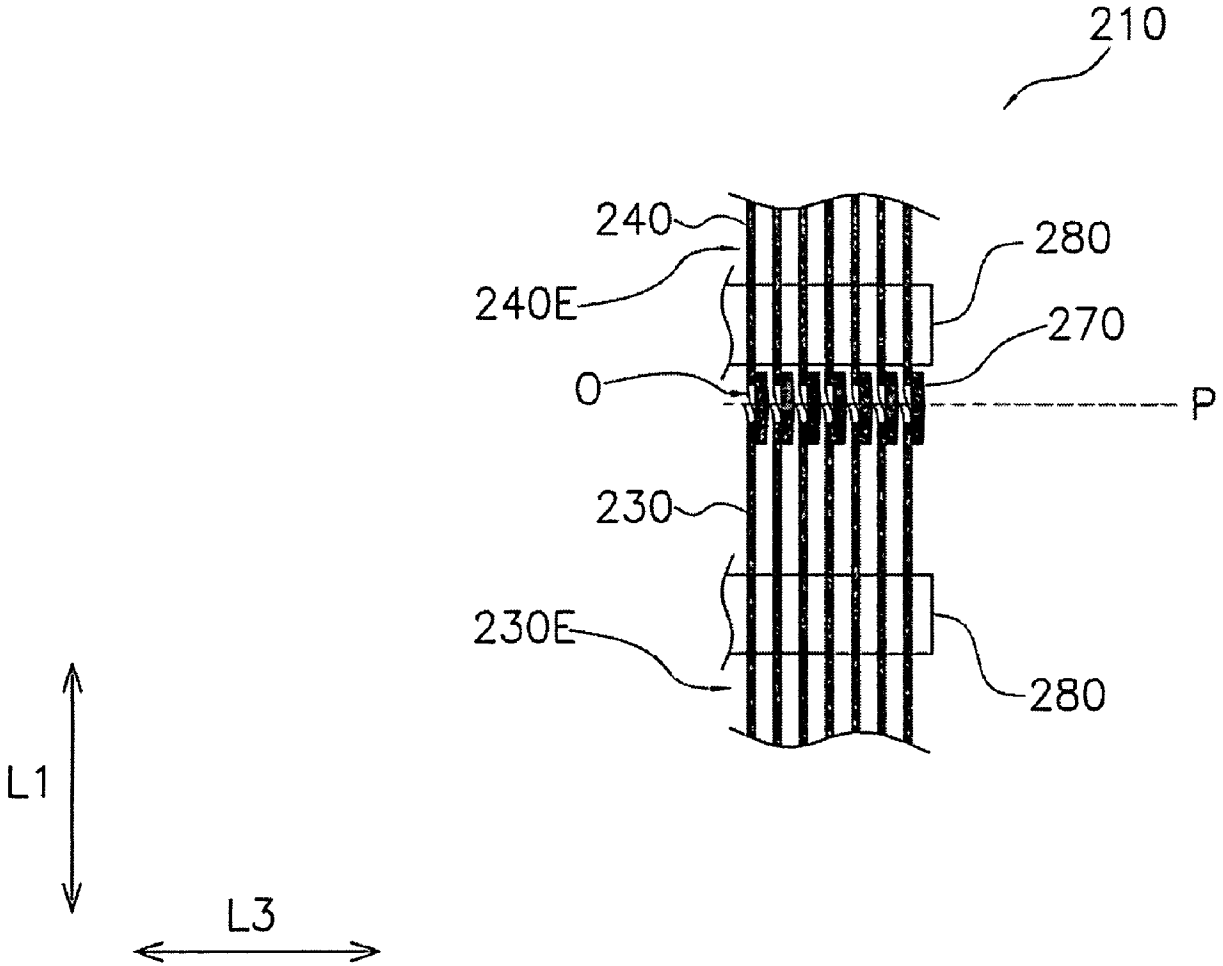
FIG. 10 is a partial enlarged front view of the folded portions of the heat exchanger according to Modification (A).

The air-shielding plates 270 can function as ventilation resistance against the air flowing in the transverse direction of the fins via the gaps O. This is because the fins are cut out in the sheet thickness direction in the border portions between the upper fins 40 and lower fins 30, as shown in FIG. 10, which is an enlarged partial view of the bent portions. Air that has undergone insufficient heat exchange and is passing through the gaps O formed by folding can thereby be rerouted, and loss of heat exchange efficiency can be reduced even in cases in which gaps O are formed in a multi-folded heat exchanger.

Condensate water flows down from the upper fins 40 to the lower fins 30 via the cut-out air-shielding plates 270, and can thereby be more effectively prevented from scattering.

(B)

Figure 11B:
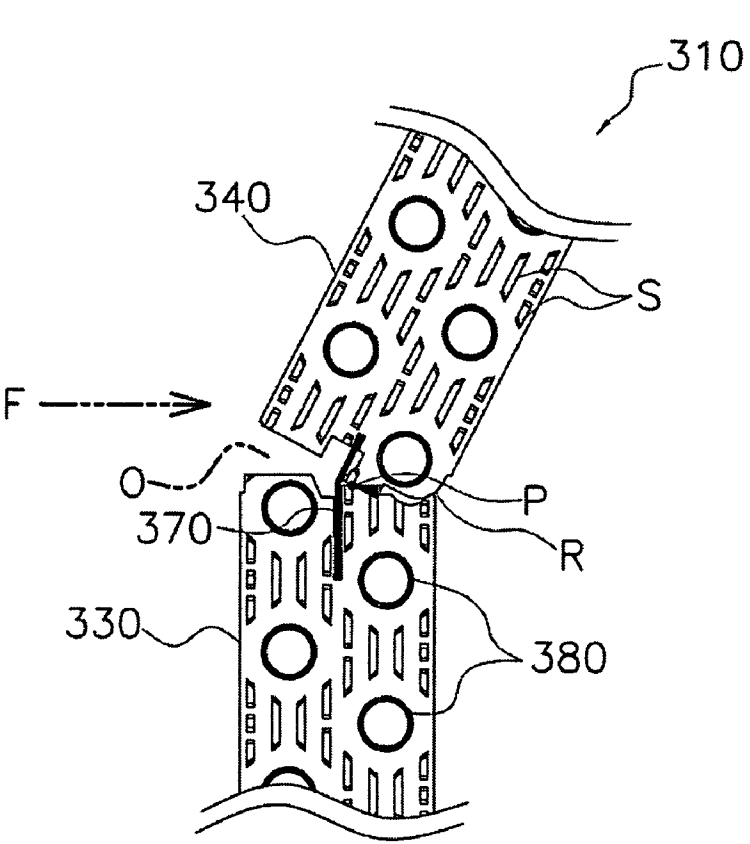
FIG. 11(*a*) is a plan view showing the state of the fins before folded according to Modification (B), and FIG. 11(*b*) is a plan view showing the state of the fins after folded according to Modification (B).
Figure 11A:
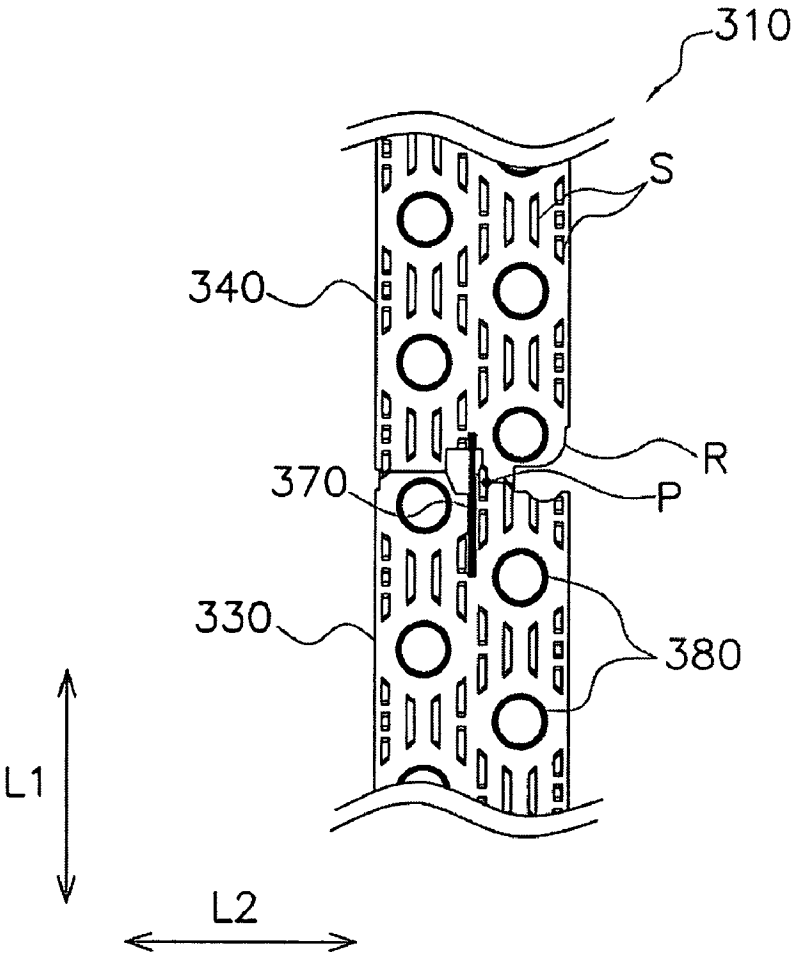

The present invention may also have a configuration having curved portions R and air-shielding plates 370 that pass through the plurality of fins in the same manner as the heat transfer tubes 88, as in the indoor heat exchanger 310 shown in FIGS. 11(*a*) and 11(*b*), for example.

The function of the air-shielding plates 370 is the same as the air-shielding plates 270 in Modification (A) and is not described. The configuration is otherwise the same as that of the embodiment described above, and corresponding components are designated by numerical symbols in the three hundreds and are not described.

(C)

Figure 12B:
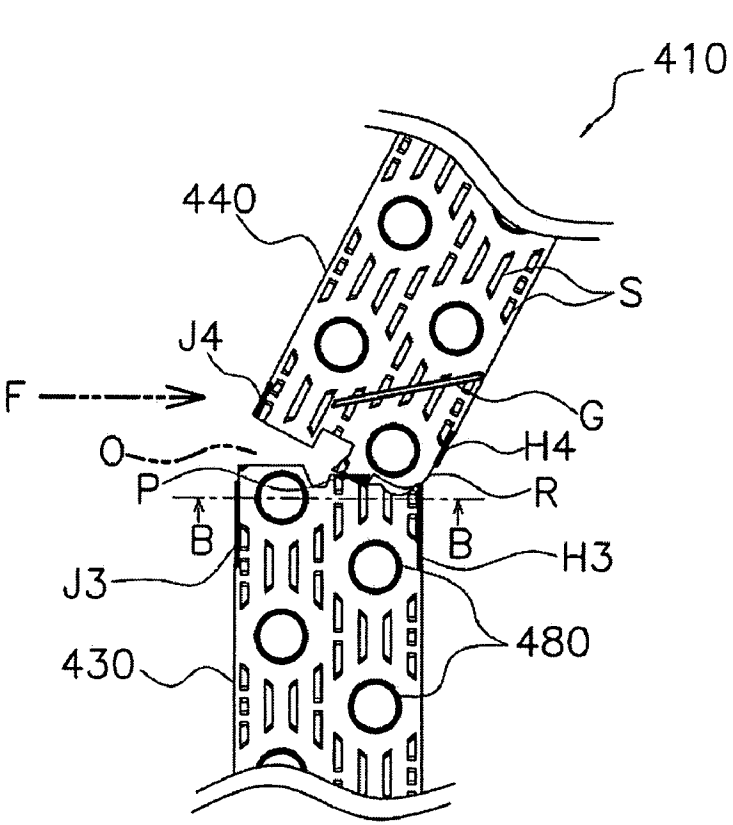
FIG. 12(*a*) is a plan view showing the state of the fins before folded according to Modification (C), and FIG. 12(*b*) is a plan view showing the state of the fins after folded according to Modification (C).
Figure 12A:
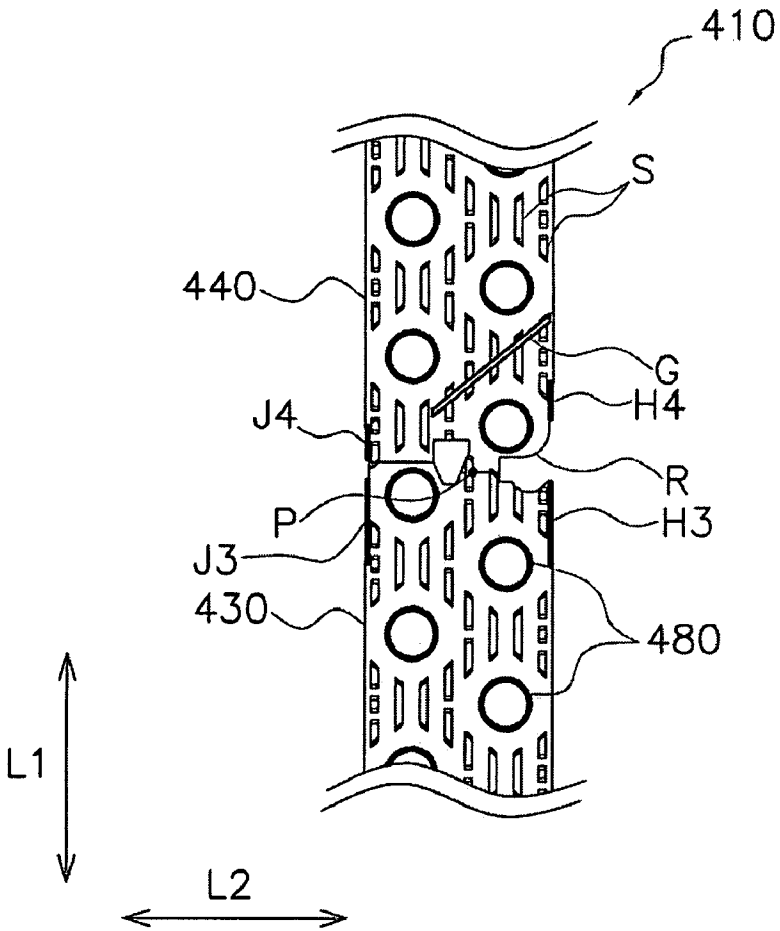

The present invention may also have a configuration in which curved portions R are provided together with water-conducting guides G, upstream stoppers J3, J4, and downstream stoppers H3, H4, as in the indoor heat exchanger 410 shown in FIGS. 12(*a*) and 12(*b*), for example.

The configuration is otherwise the same as that of the embodiment described above, and corresponding components are designated by numerical symbols in the four hundreds and are not described.

The water-conducting guides are provided so as to extend at an incline in relation to the longitudinal direction of the fins, and are formed by cutting away the fins between longitudinally adjacent holes 80 so that the water-conducting guides extend at an incline across a plurality of distended slits S. The water-conducting guides G conduct condensate water flowing across the distended slits S from the downstream side to the upstream side. Condensate water can thereby be more effectively prevented from scattering.

Figure 13:
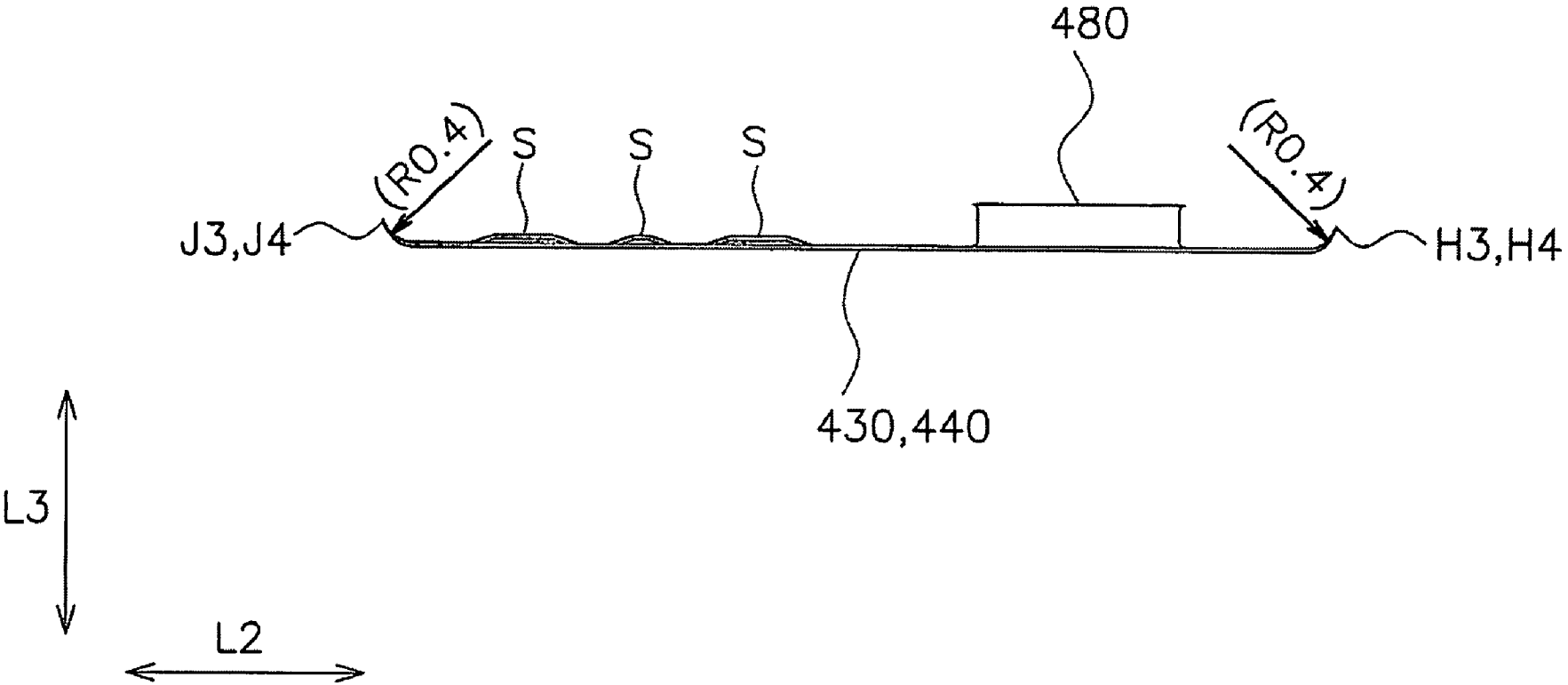
FIG. 13 is a cross-sectional view along line B-B in FIG. 12(*b*) of the heat exchanger according to Modification (C).

FIG. 13 shows a cross section along line B-B in FIG. 12(*b*), which shows the heat exchanger of Modification (C). In this arrangement, areas adjacent to the folded portions are pressed on both sides in the transverse direction, forming the downstream stoppers H3, H4 and the upstream stoppers J3, J4; and the upper fins 40 and lower fins 30 are then folded in relation to each other, thereby forming upper fins 40 and lower fins 30 having a configuration such as the one shown in FIG. 12(*b*). The upstream stoppers J3, J4 prevent condensate water from scattering upstream. The downstream stoppers H3, H4 prevent condensate water from scattering downstream. Condensate water can thereby be more reliably made to flow downward. The curvature R of the downstream stoppers H3, H4 and upstream stoppers J3, J4 is preferably about R 0.4 mm, as shown in FIG. 13.

(D)

For the indoor heat exchanger 10 of the embodiment described above, an example of an indoor heat exchanger 10 was described in which the curved portions R had a curvature R of 4.75 mm.

However, the present invention is not limited to this option alone, and the curved portions R may be configured by multiple types of curvatures R of different values. A plurality of these types of curved portions R may also be arranged.

(E)

For the indoor heat exchanger 10 of the embodiment described above, an example of an indoor heat exchanger 10 was described in which the curved portions R had a curvature R of 4.75 mm.

Figure 14:
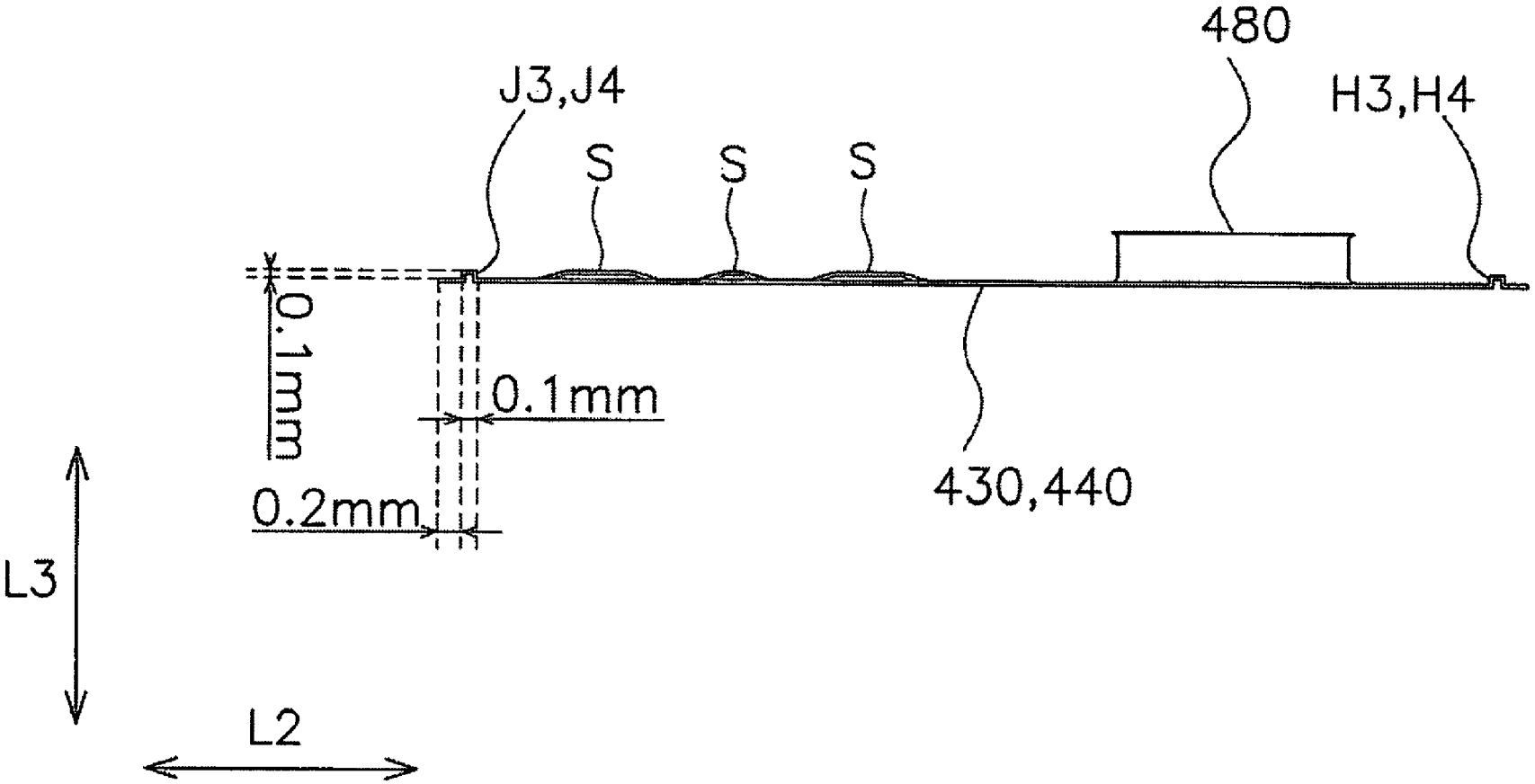
FIG. 14 is a cross-sectional view of the heat exchanger according to Modification (E), corresponding to the stoppers of Modification (C).

However, the stoppers are not limited to those according to Modification (C), and the present invention may have a configuration provided with the upstream stoppers J3, J4 and the downstream stoppers H3, H4 shown in FIG. 14, for example. Specifically, the upstream stoppers J3. J4 and downstream stoppers H3, H4 may be positioned in proximity to both transverse ends of the upper fins 430 and lower fins 440 of the indoor heat exchanger 410, and the stoppers may comprise protuberance shapes provided so as to extend in the longitudinal direction. In the portions 2 mm inward from the transverse ends, the portions 1 mm in the transverse direction are made into shapes that protrude 1 mm in the thickness direction, as shown in FIG. 14. Holes are not provided in the peripheries of the protruding shapes.

As in Modification (C) described above, condensate water can be prevented from scattering with stoppers having this type of shape as well,

INDUSTRIAL APPLICABILITY

Using the present invention makes it possible to reduce the scattering of condensate water to the downstream side in the airflow direction from curved portions, and the present invention is therefore can be used as a heat exchanger, a manufacturing method thereof, and an air conditioning apparatus comprising the heat exchanger.

What is claimed is:

1. A heat exchanger for exchanging heat with air flowing through the heat exchanger, the heat exchanger comprising:

lower fins; and upper fins being inclined in the direction of the airflow about an inclination reference point at an angle between the longitudinal axis of the upper fins and the vertical direction, the range of the angle being equal to or greater than the range of an angle formed between the longitudinal axis of the lower fins and the vertical direction, the upper fins being disposed adjacent to top ends of the lower fins, the upper fins having curved portions being curved on portions bordering the top ends of the lower fins on a downstream side in the airflow direction, each curved portion contacting a respective lower fin at a location downstream of a location at which the curved portion does not contact the lower fin such that a space is formed between the curved portion and the lower fin, the space being downstream of the inclination reference point and upstream of the location at which the curved portion contacts the lower fin.

2. The heat exchanger as recited in claim 1, wherein the upper fins have upper first edges extending along the longitudinal axis of the upper fins and constituting the downstream side in the airflow direction, and upper second edges constituting bottom sides of the upper fins, and the curved portions of the upper fins are provided to connect the upper first edges and the upper second edges.

3. The heat exchanger as recited in claim 2, wherein a downstream angle between the longitudinal axis of the upper fins and the longitudinal axis of the lower fins is 110 degrees or greater and 175 degrees or less.

4. The heat exchanger as recited in claim 3, wherein the curved portions of the upper fins have portions in which a radius of curvature of each curved portion is 3 mm or greater and 6 mm or less.

5. The heat exchanger as recited in claim 4, wherein in a case in which a downstream end of a top end of the lower fins in the airflow direction is used as a reference point, the closest possible distance between the upper first edges and a line extending along the longitudinal axis of the upper fins from the reference point is 1 mm or less.

6. The heat exchanger as recited in claim 5, wherein the upper tins have a plurality of water conduits extending along the surfaces of the upper fins along the longitudinal axis, and the water conduits are not positioned in the curved portions of the upper fins.

7. The heat exchanger as recited in claim 6, wherein the water conduits are provided at least in the top ends of the lower fins on the downstream side in the airflow direction.

8. The heat exchanger as recited in claim 7, further comprising a plurality of heat transfer tubes, wherein the upper fins have a plurality of openings passing through the fins in the thickness direction, the openings being aligned at a predetermined pitch along the longitudinal axis, the heat transfer tubes are fitted through each of the plurality of openings, and of the plurality of openings, ducts closest to the curved portions are disposed so that the closest possible distance from the curved portions is half of the predetermined pitch or less.

9. The heat exchanger as recited in claim 8, wherein the top ends of the lower fins on the downstream side in the airflow direction have recessed concavities.

10. The heat exchanger as recited in claim 2, wherein a bending angle between the longitudinal axis of the lower fins and the longitudinal axis of the upper fins is 5 degrees or greater and 70 degrees or less in cases in which the velocity of the airflow is 0.5 m/s or greater and 4.5 m/s or less.

11. An air conditioning apparatus, comprising:

a heat exchanger having lower fins, upper fins being inclined in the direction of the airflow at an angle between the longitudinal axis of the upper fins and the vertical direction, the range of the angle being equal to or greater than the range of an angle formed between the longitudinal axis of the lower fins and the vertical direction, the upper fins being disposed adjacent to top ends of the lower fins, the upper fins having curved portions being curved on portions bordering top ends of the lower fins on a downstream side in the airflow direction, the upper fins have a plurality of openings passing through the fins in the thickness direction, the openings being aligned at a predetermined pitch along the longitudinal axis, and a plurality of heat transfer tubes, the heat transfer tubes being fitted through each of the plurality of openings, of the plurality of openings, ducts closest to the curved portions are disposed so that the closest possible distance from the curved portions is half of the predetermined pitch or less, the ducts closest to the curved portions being disposed closer to the longitudinal ends of the curved portions than to the lateral sides of the curved portions; and an air-blowing device forming an airflow in the heat exchanger.

12. A method for manufacturing a heat exchanger for exchanging heat with air flowing through the heat exchanger, the method for manufacturing a heat exchanger comprising:

dividing fins into upper fins and lower fins, each of the upper fins having an upper first edge extending along the longitudinal axis of the upper fin and constituting the downstream side edge in the airflow direction, and an upper second edge constituting a bottom side of the upper fin;

forming curved portions being curved on the downstream side of the airflow direction on portions bordering the lower fins in the upper fins; and bringing the fins into a relationship in which longitudinal axes are inclined relative to each other by turning the fins in relation to each other about an inclination reference point adjacent to an approximate transverse center of the fins in a bordering portion between the upper fins and the lower fins, and bringing the fins to a position where the downstream ends of the upper fins in the airflow direction and the downstream ends of the lower fins in the airflow direction are joined via the curved portions, the bringing of the fins into the relationship including inclining each of the upper fins relative to a respective lower fin such that the closest possible distance between the upper first edge and a line extending along the longitudinal axis of the upper fin from a point at a downstream-most end of a top edge of the lower fin is 1 mm or less and greater than zero.

13. The heat exchanger as recited in claim 2, wherein in a case in which a downstream end of a top end of the lower fins in the airflow direction is used as a reference point, the closest possible distance between the upper first edges and a line extending along the longitudinal axis of the upper fins from the reference point is 1 mm or less.

14. The heat exchanger as recited in claim 1, wherein a downstream angle between the longitudinal axis of the upper fins and the longitudinal axis of the lower fins is 110 degrees or greater and 175 degrees or less.

15. The heat exchanger as recited in claim 1, wherein the curved portions of the upper fins have portions in which a radius of curvature of each curved portion is 3 mm or greater and 6 mm or less.

16. The heat exchanger as recited in claim 1, wherein the upper fins have a plurality of water conduits extending along the surfaces of the upper fins along the longitudinal axis, and the water conduits are not positioned in the curved portions of the upper fins.

17. The heat exchanger as recited in claim 16, wherein the water conduits are provided at least on the top ends of the lower fins on the downstream side in the airflow direction.

18. The heat exchanger as recited in claim 1, further comprising a plurality of heat transfer tubes, wherein the upper fins have a plurality of openings passing through the fins in the thickness direction, the openings being aligned at a predetermined pitch along the longitudinal axis, the heat transfer tubes are fitted through each of the plurality of openings, and of the plurality of openings, ducts closest to the curved portions are disposed so that the closest possible distance from the curved portions is half of the predetermined pitch or less.

19. The heat exchanger as recited in claim 1, wherein the top ends of the lower fins on the downstream side in the airflow direction have recessed concavities.

20. The heat exchanger as recited in claim 1, wherein a bending angle between the longitudinal axis of the lower fins and the longitudinal axis of the upper fins is 5 degrees or greater and 70 degrees or less in cases in which the velocity of the airflow is 0.5 m/s or greater and 4.5 m/s or less.

21. The method for manufacturing a heat exchanger according to claim 12, wherein the upper first edge of each of the upper fins has a notch that extends toward the line.

* * * * *